US006435575B1

(12) United States Patent
Pajak et al.

(10) Patent No.: US 6,435,575 B1
(45) Date of Patent: Aug. 20, 2002

(54) VEHICLE DOOR LATCH WITH POWER OPERATED UNLATCHING MECHANISM

(75) Inventors: Peter Siegfried Pajak, Wuppertal; Andreas Klaus Schlosshauer, Bonn, both of (DE); Donald Michael Perkins, Troy, MI (US)

(73) Assignee: Delphi Technologies, Inc., Troy, MI (US)

( * ) Notice: Subject to any disclaimer, the term of this patent is extended or adjusted under 35 U.S.C. 154(b) by 41 days.

(21) Appl. No.: 09/680,911

(22) Filed: Oct. 6, 2000

(51) Int. Cl.[7] ..... E05C 3/06; E05C 3/16
(52) U.S. Cl. ..... 292/216; 292/201; 292/DIG. 23
(58) Field of Search ..... 292/216, 201, 292/DIG. 23

(56) References Cited

U.S. PATENT DOCUMENTS 5,180,198 A * 1/1993 Nakamura et al. ..... 292/201
5,765,884 A * 6/1998 Armbruster ..... 292/216
5,802,894 A * 9/1998 Jahrsetz et al. ..... 70/264
6,019,402 A 2/2000 Arabia, Jr. et al.
6,053,543 A 4/2000 Arabia, Jr. et al.
6,254,148 B1 * 7/2001 Cetnar ..... 292/201

* cited by examiner

*Primary Examiner*—Anthony Knight
*Assistant Examiner*—John B. Walsh
(74) *Attorney, Agent, or Firm*—Kathryn A. Marra

(57) ABSTRACT

A vehicle door latch has a forkbolt, a detent that holds the forkbolt in a latched position, a manually operated release mechanism that moves the detent to release the forkbolt, a lock mechanism for disabling the release mechanism, a double lock mechanism and a power operated unlatching mechanism that moves the detent to release the forkbolt independently of the manually operated release mechanism, the lock mechanism and the double lock mechanism. The power operated unlatching mechanism includes a power unlatching lever and a motor driven actuator having a jackscrew for moving the power unlatching lever.

13 Claims, 3 Drawing Sheets

VEHICLE DOOR LATCH WITH POWER OPERATED UNLATCHING MECHANISM

This invention relates generally to a vehicle door latch and more particularly to a vehicle door latch that has a forkbolt, a detent for holding the forkbolt in a latched position, a release mechanism for moving the detent to a position releasing the forkbolt, a lock mechanism for disabling the release mechanism, and an intermittent lever attached to the detent for moving the detent to the position releasing the forkbolt.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

The door latch is operated remotely from the exterior of the automobile by two distinct operators—typically a key cylinder that controls the lock mechanism and an outside door handle or push button that controls the release mechanism.

The door latch is also operated remotely from inside the passenger compartment by two distinct operators—a sill button that controls the lock mechanism and an inside door handle that controls the release mechanism.

Vehicle door latches for upscale automobiles also typically include a power assembly which also operates the lock mechanism and/or a keyless entry in which a key fob transmitter sends a signal to a receiver in the vehicle to operate a power assembly for the motor driven lock mechanism.

It is also known to provide a double lock mechanism to disable the lock mechanism so that is cannot be operated by the sill button or other inside lock mechanism operator.

U.S. Pat. No. 6,053,543 granted to Frank Joseph Arabia et al Apr. 25, 2000 discloses a vehicle door latch that has a forkbolt and a spring biased detent that holds the forkbolt in a latched position. The spring biased detent is moved by a manually operated release mechanism that includes an intermittent lever that operates on a pin that is attached to the detent. The lower end of the intermittent lever is pivotally attached to one end of an inside unlatching lever by a pivot pin. The other end of the inside unlatching lever has a generally perpendicular tab that is used for operating the unlatching lever by an inside door handle or the like. When the inside door handle or its equivalent rotates the unlatching lever, the intermittent lever is pulled down moving the pin and detent to a release position where the fork bolt is released allowing the vehicle door to be opened from inside the vehicle.

The release mechanism of the door latch also includes an outside release lever or unlatching lever. One end of the outside unlatching lever is pivotally mounted on a stud while the opposite end of the outside unlatching lever is adapted for operating the outside unlatching lever by an outside handle or the like. When the outside handle or its equivalent rotates the outside unlatching lever, the unlatching lever engages the pin attached to the intermittent lever and pulls the intermittent lever down moving the detent to a release position where the fork bolt is released allowing the vehicle door to be opened from outside the vehicle.

The door latch includes a lock mechanism that includes the intermittent lever and that is preferably power operated. The door latch also includes an optional power operated double lock mechanism. However, the door latch does not have any provision for power operation of the release mechanism described above.

SUMMARY OF THE INVENTION

The object of this invention is to provide a vehicle door latch that has a power operated unlatching mechanism.

A feature of the vehicle door latch of the invention is that the power operated unlatching mechanism does not eliminate either the lock mechanism which may be power operated or the power operated double lock.

Another feature of the vehicle door latch of the invention is that the power operated unlatching mechanism does not eliminate the manual operation of the release mechanism from either inside or outside the vehicle.

Still another feature of the vehicle door latch of the invention is that the power operated unlatching mechanism unlatches the door latch even when the door latch is locked or double locked.

Yet another feature of the vehicle door latch of the invention is that the power operated unlatching mechanism involves the addition of a single lever, and a motor driven actuator for moving the lever.

These and other objects, features and advantages of the invention will become apparent from the description below, which is given by way of example with reference to the accompanying drawings.

DESCRIPTION OF THE PREFERRED EMBODIMENT

Figure 1:
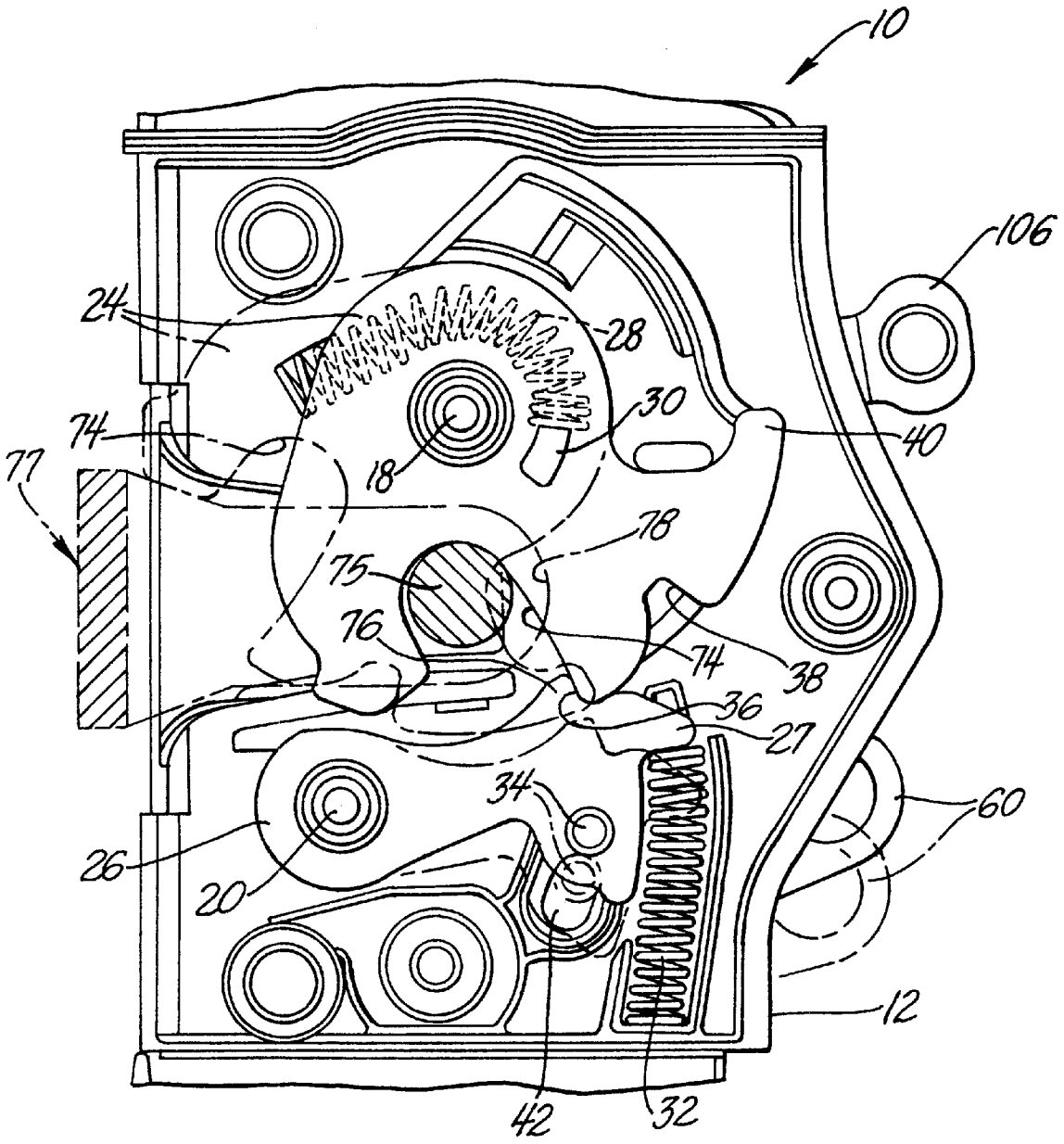
FIG. 1 is a partial front view of a vehicle door latch of the invention with parts removed.

Referring now to FIG. 1, the vehicle door latch 10 has a multi-piece enclosure that comprises plastic housing 12, and a metal frame or face plate, a plastic back cover and an electric control frame that are not shown in order to illustrate internal detail. The plastic housing 12 and the metal face plate are held together by three flanged studs 18, 20 and 22 that are inserted through three holes in an intermediate wall 14 of plastic housing 12, then through three aligned holes in the metal face plate and then flanged over the metal face plate to form a forward compartment that is shown in FIG. 1.

Door latch 10 has a latch mechanism comprising a forkbolt 24 and a cooperating detent 26 that are located in the forward compartment and pivotally mounted on the forward portions of studs 18 and 20 respectively. Forkbolt 24 is biased counterclockwise in FIG. 1 by a compression return spring 28 that is disposed in a curved slot in the intermediate wall 14 of the plastic housing 12 behind forkbolt 24. Spring 28 engages a lateral lug 30 of forkbolt 24 at one end and an end wall of the curved slot at the other end. Detent 26 is biased counterclockwise in FIG. 1 into engagement with forkbolt 24 by a compression spring 32 that engages an ear 27 of detent 26 at one end. The opposite end of compression spring 32 engages an internal wall of housing 12.

Detent 26 engages forkbolt 24 at shoulder 36 and holds forkbolt 24 in a primary latched position against the bias of compression spring 28 as shown in sold line in FIG. 1. Detent 26 can also engage forkbolt 24 at shoulder 38 and hold it in an intermediate secondary latched position. Detent 26 engages forkbolt 24 at foot 40 in its unlatched or release position as shown in dashed line in FIG. 1.

Detent 32 has a lateral pin 34 that extends through housing slot 42 in 10 intermediate wall 14 into a rear compartment formed by the intermediate wall 14 of the plastic housing 12 and the plastic back cover (not shown) and the electric control frame (not shown) that are attached to the housing 12 by screws or the like. The rear compartment is illustrated in FIGS. 2 and 3 As indicated above the back cover and electric control frame are removed in FIGS. 2 and 3 to facilitate illustration of internal detail.

Figure 2:
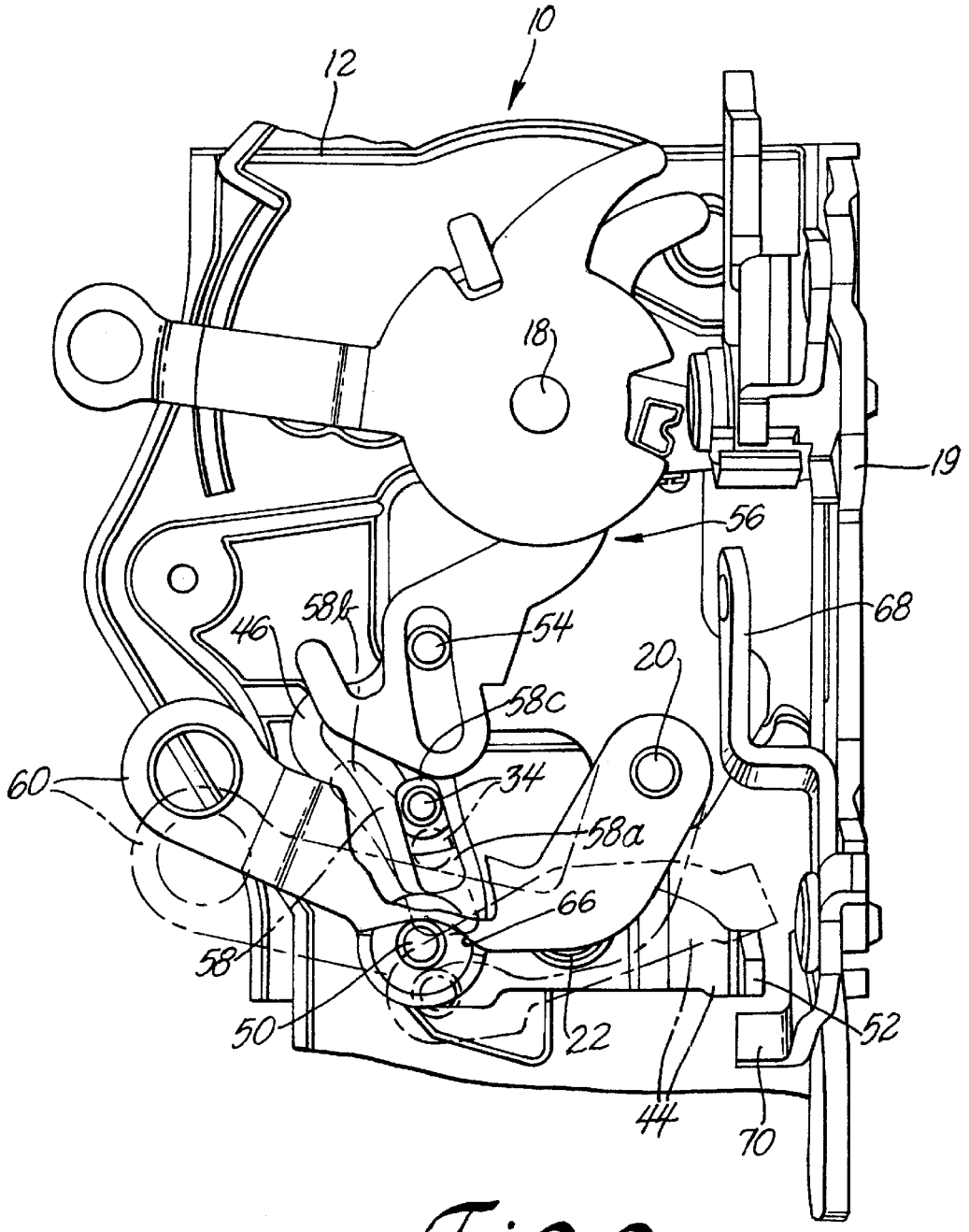
FIG. 2 is a rear view of the vehicle door latch shown in FIG. 1 with parts removed.
Figure 3:
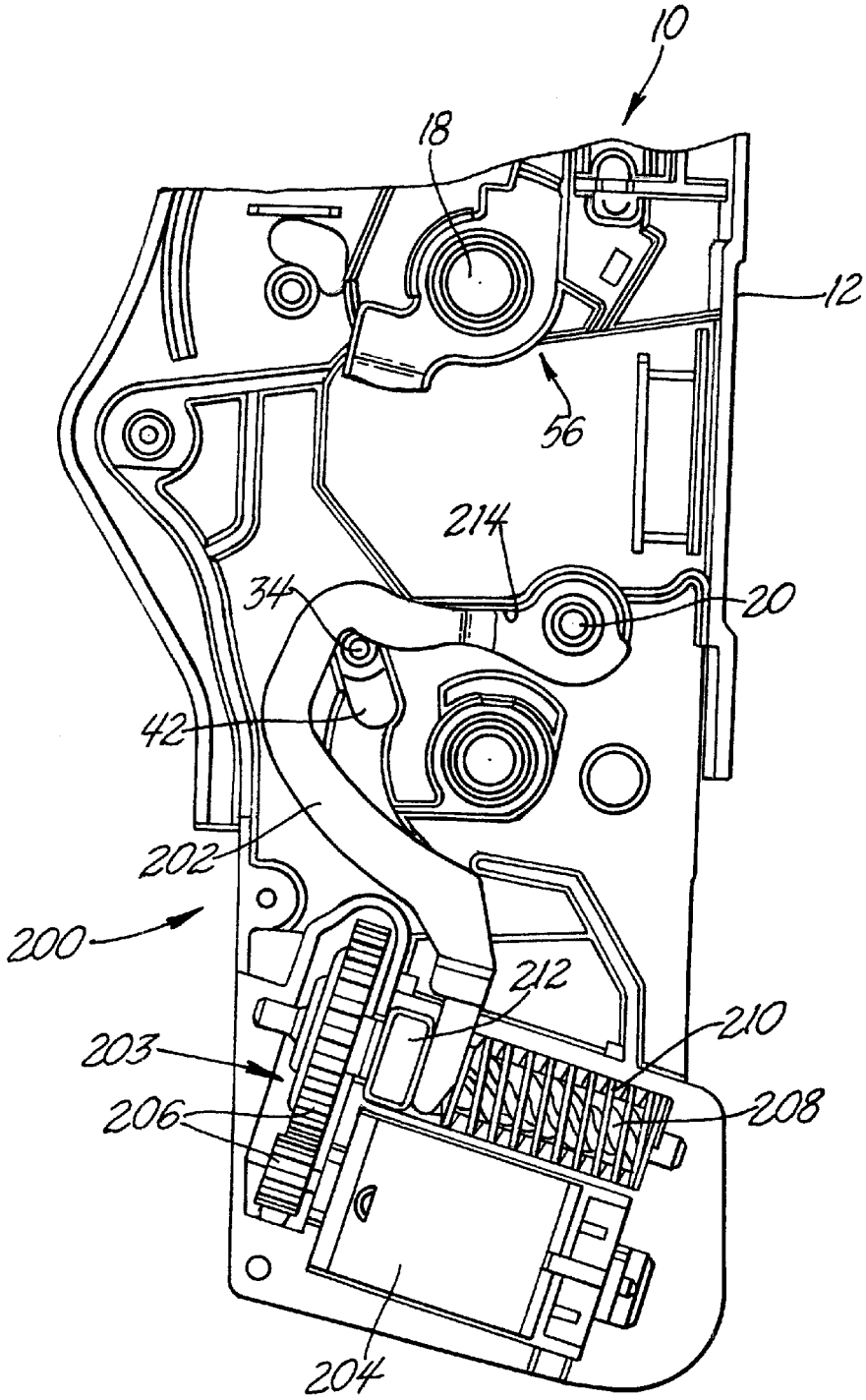
FIG. 3 is a rear view of the vehicle door latch shown in FIGS. 1 and 2 with further parts removed.

Door latch 10 has a release mechanism for releasing detent 26 and unlatching the door latch that is best shown in FIG. 2. The release mechanism comprises an unlatching lever 44 and an intermittent lever 46 for operating detent 26 that are located in the rear compartment. Unlatching lever 44 is pivotally mounted on stud 22 and held in place by a flange of stud 22. A torsion return spring (not shown) surrounds stud 22 between unlatching lever 44 and housing 12. One end of torsion return spring is anchored to housing 12 and the other end engages unlatching lever 44 so that unlatching lever 44 is biased clockwise to a generally horizontal latching position as viewed in FIG. 2.

The lower end of intermittent lever 46 is pivotally attached to one end of unlatching lever 44 by intermittent lever pin 50. Pin 50 has a forward pivot portion and a rearward drive portion that projects rearwardly of intermittent lever 46. The opposite end of unlatching lever 44 is bent outwardly to provide a generally perpendicular tab 52 that is used for operating unlatching lever 44. The upper end of intermittent lever 46 has a drive pin 54 that is disposed in a slot of a composite lock lever 56 which also forms part of a lock mechanism together with the intermittent lever 46. Intermittent lever 46 has a forward facing groove 58 located between pins 50 and 54 that receives the end of detent pin 34 that projects through housing slot 42. Detent pin 34 engages a drive shoulder 58*c* at the upper end of a short drive portion 58*a* of groove 58 when door latch 10 is unlocked as shown in FIG. 2.

Briefly the composite lock lever 56 which is pivotally mounted on the rearward portion of stud 18 is rotated counterclockwise to lock the door latch 10 or clockwise to unlock door latch 10. Counterclockwise rotation pivots intermittent lever 46 counterclockwise about lever pin 50 from an unlocked position shown in FIG. 2 to a locked position where pin 34 of detent 26 is located in a lost motion portion 58*b* of groove 58 so that intermittent lever 46 does not drive detent 26 when it is pulled down. Further description of the composite lock lever 56 and the lock mechanism which is preferably power operated is not necessary to understand this invention. However, a more complete description of composite lock lever 56 and the lock mechanism is given in the Arabia '543 patent discussed in the introduction, the Arabia '543 patent hereby being incorporated in this document by reference. The composite lock lever 56 and intermittent lever 46 are also part of the power operated double lock mechanism. Further description of the power operated double lock mechanism likewise is not necessary to understand the invention except to note that the two components identified above are part of the power operated double lock mechanism. Moreover as indicated above, a more complete description of the double lock mechanism is given in the Arabia '543 patent which has been incorporated in this document by reference.

When the lock mechanism is disengaged as shown in FIG. 2, detent 26 is rotated clockwise from the latched position shown in solid line in FIG. 1 and out of latched engagement with the forkbolt 24 to a release or unlatched position shown in dashed line in FIG. 1 when the intermittent lever 46 is pulled down. This releases forkbolt 24 so that it is free to rotate clockwise from the latched position shown in solid line in FIG. 1 to the unlatched position shown in dashed line under the bias of compression return spring 28 when the vehicle door is opened.

The release mechanism further comprises an outside release lever 60. One end of outside release lever 60 is pivotally mounted on stud 20 behind a support plate (not shown) that receives the rearward portions of studs 18 and 20 and stabilizes the studs. The opposite end of outside release lever 60 projects out of the rearward compartment formed by intermediate wall 14 of housing 12 and the back cover (not shown) for connection to an outside door handle or the like via a suitable linkage (not shown). The middle portion of outside release lever 60 and a lower edge 66 engages the rearward drive portion of intermittent lever pin 50 so that outside release lever 60 pushes intermittent lever 46 down when outside release lever 60 is rotated counterclockwise as viewed in FIG. 2.

The release mechanism further comprises an inside release lever 68 that is L-shaped. The middle of inside release lever 68 is pivotally mounted on a lower portion of a flange 19 of the metal face plate by a stud. Inside release lever 68 has an L-shaped arm 70 at the lower end that engages ear 52 of unlatching lever 44 so that inside release lever 68 rotates unlatching lever 44 counterclockwise when it is rotated counterclockwise as viewed from the left end of FIG. 2. Inside release lever 68 also has a perpendicular tab 72 at the lower end that projects into a slot in flange 19 to limit the pivotal movement of the inside release lever 68. The upper end of inside release lever 68 is connected by suitable linkage for rotation by an inside door handle or other operator (not shown).

Forkbolt 24 has a conventional slot or throat 74 for receiving and retaining a striker pin 75 of a strike assembly 77 that is attached to a vehicle door pillar (not shown) to latch the vehicle door in the closed position as shown in solid line in FIG. 1. Forkbolt 24 also includes a primary latch shoulder 36, an intermediate secondary latch shoulder 38 and a radially projecting foot 40 as indicated above. Forkbolt 24 preferably has a plastic coating that covers a surface of the slot 74 that is engaged by the strike member for energy absorption and quiet operation when the vehicle door is slammed shut.

Detent 26 has a sector shaped catch 76 that engages the radially projecting foot 40 when the forkbolt 24 is in the unlatched position shown in dashed lines in FIG. 1. The sector shaped catch 76 positively engages the primary and secondary latch shoulders 36 and 38 to hold the forkbolt 24 in either the primary latched position (FIG. 1) or the intermediate secondary latched position (not shown).

The manually operated latch mechanism described above operates as follows. When the door latch 10 is in an unlatched and unlocked condition, forkbolt 24 is poised to receive striker pin 75 as shown in dashed lines in FIG. 1. Striker pin 75 projects into fish mouth slot 78 of plastic housing 12 and an aligned fish mouth slot of the metal face plate when the door is shut. The entering striker pin 75 engages the back of the throat 74 and rotates forkbolt 24 counterclockwise against the bias of compression spring 28 until forkbolt 24 is rotated to the primary latch position shown in solid line in FIG. 1 where forkbolt 24 captures striker pin 75 in throat 74. Forkbolt 24 is held in the primary latch position by catch 76 of detent 26 engaging primary latch shoulder 36 of forkbolt 24.

Catch 76 rides along the periphery of the forkbolt 24 under the bias of compression spring 32 as forkbolt 24 rotates clockwise from the unlatched position to the primary latch position shown in FIG. 1 in dashed and solid line respectively. During this travel, catch 76 rides under the foot 40 into engagement with the intermediate secondary latch shoulder 38 and then into engagement with the primary latch shoulder 36. The engagement of catch 76 with the intermediate secondary latching shoulder 38 is sufficient to hold the vehicle door closed in the event that the vehicle door is not shut with sufficient force so that catch 76 engages primary latch shoulder 36.

The vehicle door latch 10 is now latched but not locked. Consequently the vehicle door can be opened simply by operating either an inside or outside door handle or the like to rotate inside release lever 68 or outside release lever 60 to pull intermittent lever 46 down either directly or by rotating the unlatching lever 44 counterclockwise as viewed in FIG. 2 to the unlatch position shown in dashed line. This pulls pin 50 and intermittent lever 46 down. As the intermittent lever 46 is pulled down, drive shoulder 58*c* pulls detent pin 34 down and rotates detent 26 clockwise against the bias of compression spring 32 from the primary latch position shown in solid line in FIG. 1 to the release or unlatch position shown in dashed lines in FIG. 1. Forkbolt 24 is then free to rotate counterclockwise under the bias of compression spring 28 from the primary latch position in solid line in FIG. 1 to an unlatched position shown in dashed line as striker pin 75 is pulled out of throat 74 and the aligned fishmouth slots when the vehicle door is opened.

The power operated unlatching mechanism of the invention will now be described in connection with FIG. 3 where components of the manually operated release mechanism have been removed to show internal details.

The power unlatching mechanism 200 comprises a sickle shaped power unlatching lever 202 and a motor driven actuator 203 that moves the power unlatching counterclockwise between the rest position shown in FIG. 3 and an unlatch position about 15° from the rest position in the counterclockwise direction. Actuator 203 comprises an electric motor 204, a gear set 206, a jackscrew 208 and a compression spring 210. Power unlatching lever 202 is pivotally mounted on stud 20 at one end beneath the manual unlatching lever 60 (shown in FIG. 2). The opposite end of power unlatching lever 202 is biased against a translatable output block 212 ofjackscrew 208 by compression spring 210.

The middle part of power unlatching lever 202 lies below intermittent lever 46 (shown in FIG. 2) and engages detent pin 34 where detent pin 34 emerges from housing slot 42 and before detent pin 34 enters the forward facing groove 58 of intermittent lever 46. Thus the power unlatching lever 202 by-passes the intermittent lever 46 and operates directly on the detent pin 34 of detent 26 so that the inside and outside manual unlatching operations described above are maintained. Moreover, the power locking and double locking operations are also maintained because the of power unlatching lever 202 by passing intermittent lever 46.

The power operated unlatching mechanism 200 operates as follows. A control switch is actuated that energizes electric motor 204 through a motor control circuit to drive jackscrew 208 counterclockwise for a predetermined amount of time. The control switch can be manually operated or automatically operated responsive to vehicular drive or both. Such control switches and motor control circuits are well known in the art and need not be described in detail.

Suffice it to state that electric motor 204 is energized to drive jackscrew 208 counterclockwise for a short period of time moving output block 212 to the right as viewed in FIG. 3. This pivots power unlatching lever 202 about 15° counterclockwise on stud 20 from the rest position shown in FIG. 3 which pulls detent pin 34 down in slot 42. Pulling detent pin 34 down rotates detent 26 clockwise against the bias of spring 32 from the solid line position shown in FIG. 1 to the release position shown in dashed lines. This releases fork bolt 24 allowing the vehicle door (not shown) to be opened.

Power unlatching lever 202 stops when detent pin 34 bottoms out in slot 42. This stalls the electric motor 204 and the sickle shaped power unlatching lever 202 is returned to the rest position of FIG. 3 against stop 214 by compression spring 210. Alternatively, electric motor 204 can be stopped by a limit switch that detects either the release position of power unlatching lever 202 or the unlatched position of the vehicle door.

Since the power unlatching lever 202 by-passes intermittent lever 46, the door latch 10 can be unlatched by the power operated unlatching mechanism 200 even if the door latch 10 is locked and double locked.

Door latch 10 may also include an optional power lock mechanism and an optional double lock mechanism both of which are described in detail in the Arabia '543 patent. As indicated above, neither mechanism needs to be described in detail to understand this invention so that the detailed description of the mechanism and their respective operations are not repeated here.

Many modifications and variations of the present invention in light of the above teachings may be made. It is, therefore, to be understood that, within the scope of the appended claims, the invention may be practiced otherwise than as specifically described.

What is claimed is:

1. A vehicle door latch having a forkbolt that moves between a latched position and an unlatched position, a detent for holding the forkbolt in the latched position, a release mechanism for moving the detent to a position releasing the forkbolt, a lock mechanism for disabling the release mechanism, an intermittent lever attached to the detent for moving the detent to the position releasing the forkbolt, and characterized by a power operated unlatching mechanism for moving the detent to the position releasing the forkbolt, the power operated unlatching mechanism comprising:

a power unlatching lever moveable from a rest position to an unlatch position for moving the detent to the position releasing the forkbolt without the necessity of moving the intermittent lever attached to the detent, a motor driven actuator for moving the power unlatching lever back and forth between the rest position and the unlatch position, the detent having a lateral pin, the intermittent lever engaging the lateral pin for moving the detent to the position releasing the forkbolt, and the power unlatching lever engaging the lateral pin to move the detent to the position releasing the forkbolt.

2. The vehicle door latch as defined in claim 1 wherein the power unlatching lever is located between the detent and the intermittent lever so as to engage the lateral pin between the detent and the intermittent lever.

3. The vehicle door latch as defined in claim 1 wherein the motor driven actuator includes a jackscrew engaging the power unlatching lever and an electric motor that is drivingly connected to the jackscrew.

4. A vehicle door latch having a forkbolt that moves between a latched position and an unlatched position, a detent for holding the forkbolt in the latched position, a release mechanism for moving the detent to a position releasing the forkbolt, a lock mechanism for disabling the release mechanism, an intermittent lever attached to the detent for moving the detent to the position releasing the forkbolt, and characterized by a power operated unlatching mechanism for moving the detent to the position releasing the forkbolt, the power operated unlatching mechanism comprising:

a power unlatching lever moveable from a rest position to an unlatch position for moving the detent to the position releasing the forkbolt without the necessity of moving the intermittent lever attached to the detent, a motor driven actuator for moving the power unlatching lever back and forth between the rest position and the unlatch position, the detent having a lateral pin and the power unlatching lever engaging the lateral pin to move the detent to the position releasing the forkbolt, the motor driven actuator including a jackscrew engaging the power unlatching lever and an electric motor that is drivingly connected to the jackscrew, and a compression spring biasing the power unlatching lever against a translatable nut of the jackscrew.

5. The vehicle door latch as defined in claim 4 wherein the power unlatching lever is pivotally mounted in the vehicle door latch at one end and engages the nut of the jackscrew at an opposite end.

6. The vehicle door latch as defined in claim 5 wherein the power unlatching lever pivots about a pivot pin upon which a manually operated unlatching lever pivots.

7. The vehicle door latch as defined in claim 6 wherein the intermittent lever is attached to the detent by a lateral pin of the detent that engages in a groove of the intermittent lever and the power unlatching lever engages the lateral pin between the intermittent lever and the detent to move the detent to the position releasing the forkbolt.

8. The vehicle door latch as defined in claim 7 wherein the power unlatching lever is sickle shaped.

9. A vehicle door latch having a forkbolt that moves between a latched position and an unlatched position, a detent for holding the forkbolt in the latched position, a release mechanism for moving the detent to a position releasing the forkbolt, a lock mechanism for disabling the release mechanism, an intermittent lever attached to the detent for moving the detent to the position releasing the forkbolt, and characterized by a power operated unlatching mechanism for moving the detent to the position releasing the forkbolt, the power operated unlatching mechanism comprising:

a power unlatching lever moveable from a rest position to an unlatch position for moving the detent to the position releasing the forkbolt without the necessity of moving the intermittent lever attached to the detent, a motor driven actuator for moving the power unlatching lever back and forth between the rest position and the unlatch position, the motor driven actuator including a jackscrew engaging the power unlatching lever, an electric motor that is drivingly connected to the jackscrew, and a compression spring biasing the power unlatching lever against a translatable nut of the jackscrew.

10. The vehicle door latch as defined in claim 9 wherein the power unlatching lever is pivotally mounted in the vehicle door latch at one end and engages the nut of the jackscrew at an opposite end.

11. The vehicle door latch as defined in claim 10 wherein the power unlatching lever pivots about a pivot pin upon which a manually operated unlatching lever pivots.

12. The vehicle door latch as defined in claim 10 wherein the intermittent lever is attached to the detent by a lateral pin of the detent that engages in a groove of the intermittent lever and the power unlatching lever engages the lateral pin between the intermittent lever and the detent to move the detent to the position releasing the forkbolt.

13. The vehicle door latch as defined in claim 12 wherein the power unlatching lever is sickle shaped and pivots about a pivot pin upon which a manually operated unlatching lever pivots.

* * * * *